United States Patent [19]

Moffitt, Jr.

[11] 4,361,614

[45] Nov. 30, 1982

[54] SLIP RESISTANT MAT WITH MOLDING AND METHOD OF ASSEMBLY

[76] Inventor: Merritt L. Moffitt, Jr., 9 Weirwood Rd., Radnor, Pa. 19087

[21] Appl. No.: 265,491

[22] Filed: May 20, 1981

[51] Int. Cl.[3] ..... B32B 3/26; B32B 7/04

[52] U.S. Cl. ..... 428/138; 52/177; 156/250; 156/293; 428/177; 428/179; 428/192

[58] Field of Search ..... 428/81, 60, 138, 192, 428/177, 179; 4/581, 582; 15/238, 15; 238/14; 52/177, 179, 181, 660, 673; 296/1 F; 156/250, 293

[56] References Cited

U.S. PATENT DOCUMENTS

| | | | |
|---|---|---|---|
| 2,070,839 | 2/1937 | Place | 52/177 |
| 2,810,672 | 10/1957 | Taylor | 428/138 |
| 3,846,945 | 11/1974 | Roby | 52/177 |
| 3,946,529 | 3/1976 | Chevaux | 52/177 |
| 4,167,599 | 9/1979 | Nissinen | 4/581 |
| 4,226,064 | 10/1980 | Kraayenhof | 52/180 |

*Primary Examiner*—Paul J. Thibodeau
*Attorney, Agent, or Firm*—John J. Simkanich

[57] ABSTRACT

A slip resistant mat assembly for use on boats and other pleasure craft has a custom molding providing an edge trim and being usable for securing the mat in place against both vertical and lateral movement, whereof the mat portion includes vertically downwardly extending studs upon which it stands, a portion of these studs passing into the molding and being interlocked thereto, the molding being securable to the surface upon which the mat studs rest.

22 Claims, 3 Drawing Figures

SLIP RESISTANT MAT WITH MOLDING AND METHOD OF ASSEMBLY

BACKGROUND OF THE INVENTION

This invention relates to mats, treads and the like used on slippery surfaces such as wet floors to provide slip resistant walking areas, and more specifically to such mats which are securely fastened to such floor by any of a plurality of securement means.

Wet floors, especially wet floors and decks on pleasure boats and the like, provide a hazardous surface for walking. The typical solution to this slipping hazard has been to place a plastic or rubber mat on such walking or stepping surfaces to provide a slip resistant walking surface therefor. These mats usually have any of corrugated, knobby, studded, waffle, or grooved surface configurations which provide projections of the mat material which roll, grip or otherwise deform under the pressure of a person standing or walking thereon to provide a frictional contact with the sole of an individual walking thereon.

A foam backing, waffle backing or studded backing is typically used for these mats. Such backing is intended to reduce the amount of fluid between the mat and the floor or deck and/or to raise the mat surface away from the floor or deck. With studs or waffle surface, the effective surface area of the mat in contact with the wet floor or deck is greatly reduced, causing the pressure force per square inch to greatly increase thereby increasing the friction against the floor or deck.

Even so, when studded slip resistant mats are used, the density of the studs coming in contact with the floor must be quite high or the mat will usually deform when walked on and the lateral surface of the mat will come in contact with the floor greatly reducing the frictional effect of the studs. It has been a problem that such mats, while of a desirable design, move or slip about upon occasion. Moreover, such slip resistant mats are often moved or kicked and moved out of position when an individual trips, kicks against them or otherwise brushes against them.

It would be quite desirable to provide such mats when used on pleasure boats and the like with a molding or trim which adds to their appearance and provides for a functional securement means to the deck. On pleasure boats, however, most trim is metal or wood, especially teak or cedar woods. Slip resistant mats very often are constructed of natural or synthetic rubbers or plastic. An efficient and economic mating of two dissimilar materials such as plastic and wood provides a manufacturing problem and is an economic concern of a manufacturer.

An object of the present invention is to provide a slip resistant mat for use on wet surfaces such as pleasure boat decks having a separate trim portion running the periphery of the mat, this trim portion being utilized to secure the mat to the surface of such deck.

Another object of this invention is to provide such a mat with downwardly projecting studs, these studs supporting the walking surface of the mat above the deck surface and coming in contact with this deck surface.

Another object of this invention is to provide this mat with a wood trim having a mating surface for interlocking with a plurality of the downwardly projecting studs of the mat and for providing a contiguous frame to the walking surface of the mat.

A further object of this invention is to provide such a slip resistant mat with molding whereof the studs are locked to the molding by interlockment among themselves once being passed through a portion of this molding.

An even further object of this invention is to provide a method of assembling the slip resistant mat and trim molding of the invention for interlocking certain of the studs of the mat together to bind the mat with the molding without the need of a direct securement or adherence between the mat to the trim molding.

SUMMARY OF THE INVENTION

The objects of this invention are realized in a slip resistant mat assembly for use on boat decks and other slippery surfaces having as an integral part thereof molding extending about the periphery providing an edge trim and being used to secure the mat in place against both vertical and lateral movement.

The slip resistant mat is cut to size and shape from a large sheet of such matting made from natural or synthetic rubber or plastic materials. The mat is molded with a dented walking surface and a plurality of studs extending downwardly from the bottom surface. These studs are evenly spaced apart and extend a like distance from the bottom of the mat.

A trim member can be of dissimilar material and constructed as a separate structure to be assembled as part of the finished mat assembly. This trim member includes a trim piece running laterally about the mat. The trim piece has an essentially rectangular cross-section with a beveled outer edge and a raised platform portion running lengthwise along the trim structure. This raised platform meets the top locking surface of the mat when assembled onto a lower ledge surface opposite the beveled edge.

The lower ledge of the trim piece contains a plurality of holes having a spacing corresponding to the spacing of the downwardly projecting studs of the mat portion for engaging a plurality of these studs.

An undercut channel in the bottom surface of the trim piece runs continuously through the plurality of holes and provides a space to be filled with adhesive or bonding material compatible with the material of the studs while not necessarily bonding or adhering to the trim piece.

The slip resistant mat may be assembled by cutting a mat section of any desired shape from the large sheet of mat material and assembling a trim piece in straight sections or curved sections as the mat's finished piece may require, so that the projecting studs extend through the trim piece into the undercut channel portion thereof. Following this assembly, the channel is filled with liquid adhesive which bonds the projecting ends of the studs together to form a stitch-like structure thereby locking the slip resistant mat portion to the trim piece. The raised platform of the trim provides a relatively rigid continuation and border to the edge of the slip resistant mat and a nailing surface for nailing the trim piece to the deck.

DESCRIPTION OF THE DRAWINGS

The novel features, structure and advantages of this invention will be readily understood from a reading of the following detailed description of the invention in conjunction with the attached drawings, in which like numerals refer to like elements, and wherein.

Figure 1:
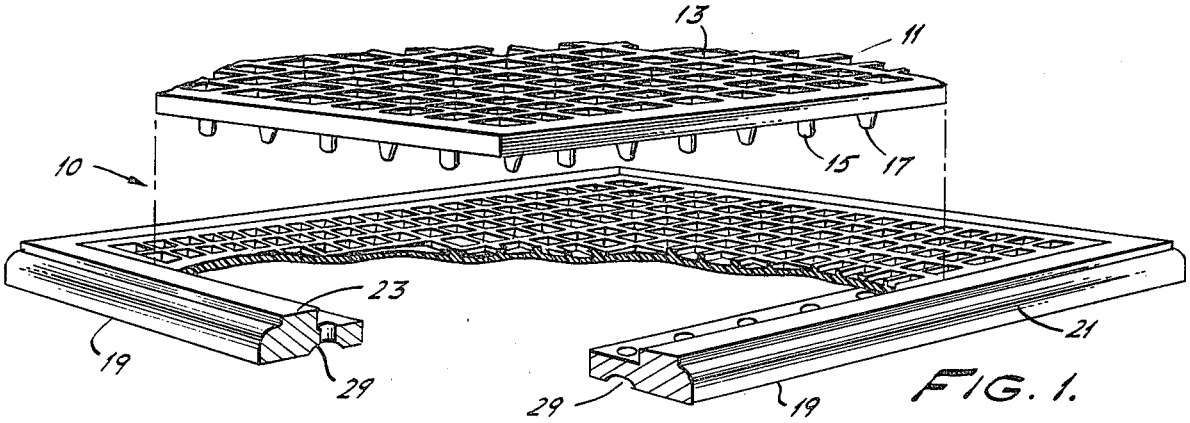
FIG. 1 is an exploded perspective view of a section of the mat assembly of the subject invention.
Figure 2:
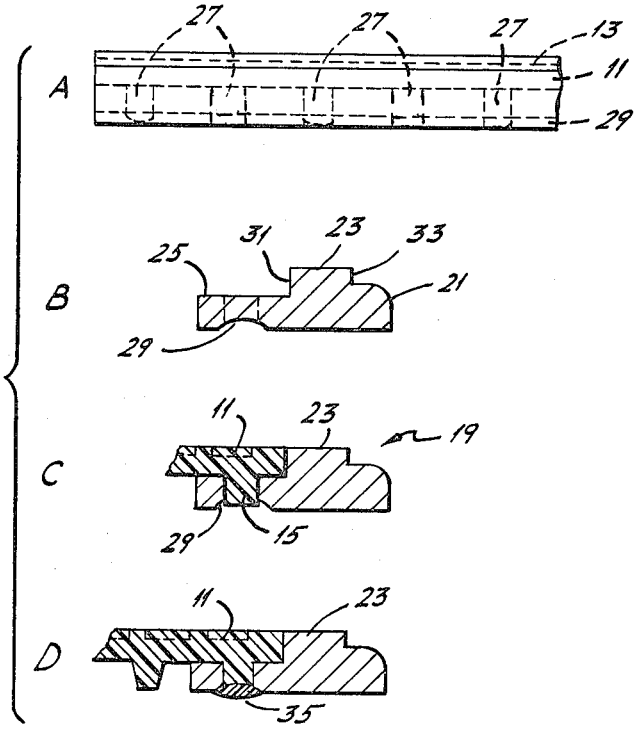

FIG. *2a* shows a side view of the wood trim piece of FIG. 1.

FIG. *2b* shows an end or lengthwise view of the trim piece of the mat assembly of FIG. 1.

FIG. *2c* shows an end or cross-sectional view of the wood trim piece of FIG. *2b* and a sectional view of the slip resistant mat assembled thereon.

FIG. *2d* shows the assembly as shown in FIG. *2c* with the undercut channel filled with adhesive about the projecting ends of the studs.

Figure 3:
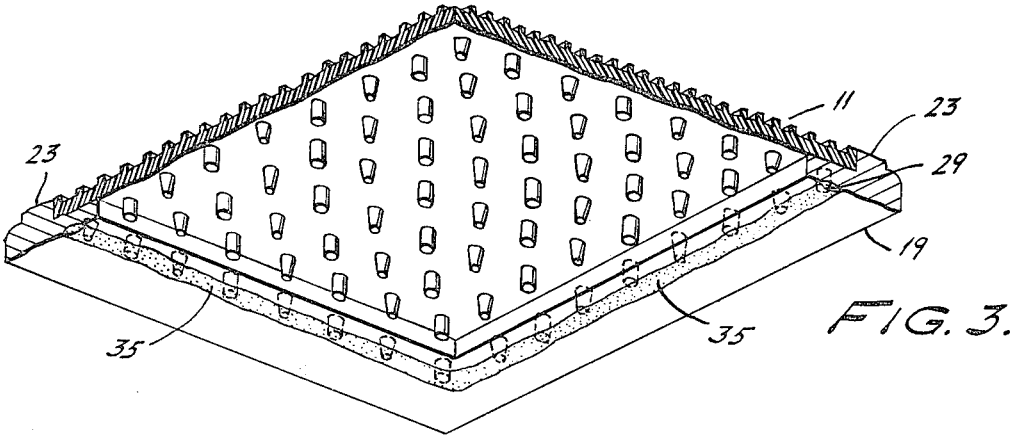

FIG. 3 shows a perspective view of a section of the mat assembly of the subject invention shown from the bottom of the mat in its assembled state.

DETAILED DESCRIPTION OF THE INVENTION

A slip resistant mat with perimeter molding 10 is shown in FIG. 1. A formed or molded mat structure 11 is constructed from a pliable, injection moldable or formable slip resisting material such as natural or synthetic rubber or any of a class of porous or semi-porous plastics. This mat 11 has a relatively flat top or walking surface containing a plurality of depressions or detents 13 evenly spaced throughout the top surface of the mat 11 in a random pattern or a regular pattern as may be chosen.

Protruding from the bottom surface of the mat 11 are a plurality of downwardly extending studs 15. These studs 15 are cylindrically shaped and each extend an identical distance. Inter-dispersed between the cylindrical studs 15 are a plurality of tapered or truncated conical studs 17. The cylindrical studs 15 and tapered studs 17 are arranged in alternating order to extend downwardly vertically from the bottom of the mat 11 a distance equal to the length of the cylindrical studs 15. The base diameter dimension of each of the studs 15, 17 is identical.

The mat 11 can be of any of a variety of thicknesses. However, it is most commonly from one-quarter to one-half of an inch thick, with the studs 15, 17 protruding from one-quarter to one-half of an inch from the bottom surface of the mat 11. The studs 15, 17 are spaced apart a distance sufficient to provide proper weight bearing distribution of a walking person on the mat 11. Typically the studs are spaced from one-eighth to one-quarter of an inch apart and have a base diameter, i.e., the diameter of the studs 15, 17 where they mate with the bottom of the mat 11, of approximately one-eighth to three-eighths of an inch. Some versions of the mat 11 provide for studs 15, 17 length of only one-eighth of an inch. Mat 11 material is available commercially in the marketplace.

When the mat 11 is purchased commercially, it can be cut to size and shape from a large sheet of stock. This shape may be rectangular, circular or irregular as constrained by the space of its intended use and the availability of configurations for the trim 19 shape.

The trim piece 19 can be made of a plurality of materials including extruded aluminum or other metal such as brass or bronze, plastic or wood. In instances where the mat 10 is used for boats and other nautical applications the wood trim 19 is typically made of teak or mahogany wood.

Wood trim 19 has essentially a rectangular cross-section with a beveled outer edge 21 and a raised platform portion 23 immediately adjacent to the beveled edge 21. The platform portion 23 extends lengthwise along the trim 19 adjacent to the beveled edge 21. A lower ledge 25 provides a horizontal surface below the top of the bevel 21 or the raised platform portion 23. This lower edge 25 extends outwardly from the raised platform portion 23 and runs lengthwise along the trim 19. This lower ledge 25 contains a plurality of holes 27 which extend vertically downwardly from the top surface and are of a spacing for receiving the studs 15, 17 of the plastic mat portion 11. The holes 27 extend completely through the trim 19.

A semicircular channel 29 is undercut along the length of the bottom of the trim piece 19 through the end of the holes 27 which extend through the trim 19 at the lower ledge 25 location.

With the mat 11 assembled onto the trim 19, the studs 15, 17 are inserted into the holes 27 to full depth so that the bottom of the mat 11 rests directly on the top surface of the lower ledge 25 and the ends of the studs 15, 17 project through the trim 19 into the semicircular channel 29.

Typically, the channel 29 projects into the trim 19 about one-eighth to one-quarter of an inch depending upon the type of mat 11 used and the dimensions of the studs 15, 17, see FIG. *2a*. These holes 27, FIG. *2a*, are evenly spaced when the studs 15, 17 are evenly spaced and have a uniform diameter even though every alternate stud is a tapered stud 17.

FIG. *2b* shows that the platform portion 23 provides a horizontal surface which is truncated at vertical faces 31, 33 on either side thereof. The vertical face 31 adjacent to the lower ledge 25 is larger than the outside vertical face 33 when the radius of the beveled edge 21 is large enough to extend that bevel 19 higher than the lower ledge 25.

With the mat 11 assembled onto the trim 19, FIG. *2c*, the top face of walking surface of the mat 11 is at the same height as the top of the platform portion 23 so that the platform portion 23 provides a border adjacent to the mat 11 at the same elevation and contiguous therewith.

As seen in FIG. *2c*, with the mat 11 inserted into the trim 19 the studs 15 project into the semicircular channel 29. With this portion of the assembly completed, the channel 29 is then filled with a liquid plastic adhesive 35 or other material which readily bonds to the studs 15, 17 locking the projecting ends of these studs 15, 17 together, and creating a plastic "stitch" of those studs 15, 17 together, thus locking the mat 11 positively to the trim 19 via the outer row of studs 15, 17. The adhesive 35 chosen does not have to be compatible with the trim 19 but must only be compatible with bonding the tips of the studs 15, 17 while having sufficient strength that once secured it will not break itself or break away from the studs 15, 17. This adhesive 35 can be of any of commercially available substances chosen according to the material used for the mat 11.

FIG. 3 shows the assembly of the mat 11 with trim member 19. Here the studs 15 and 17 bonded together vie the plastic adhesive 35 while assembled onto the trim 19 with the ends of the studs 15, 17 extending through the holes 27 and into the channel 29 with the plastic adhesive filling that channel 29.

Once the mat assembly 10 is assembled as shown in FIG. 3 and the adhesive 35 applied, it may remain undisturbed until the adhesive 35 is cured. Once the adhesive 35 is cured and all pieces of the trim 19 have been applied to the mat 11 in this manner so as to completely surround the mat 11, the mat assembly 10 can be packaged for sale or may be mounted onto a boat deck by nailing, bolting or otherwise securing the trim 19 to the deck.

Many changes can be made in the above-described mat assembly without departing from the intent and scope thereof. As an example, modifications can be made in the shape of the trim 19 while remaining within the scope of the present invention. When a mat 11 is used which does not have studs 15, 17 as described hereinabove, but has an alternate configuration such as a waffle weave, or linear rows of ridges or alternate configurations, the trim 19 is altered in configuration to accept a number of such projections in order that these projections may be locked together adhesively or by other means which is compatible to the material from which the mat projections are made while not necessarily to the material of the trim 19. The trim 19 likewise may not necessarily have a beveled outer edge 21. Any of alternate configurations may be incorporated for this trim. It is intended, therefore, that all matter contained in the above description and shown in the accompanying drawings be interpreted as illustrative and not be taken in a limiting sense.

What is claimed is:

1. A slip resistant mat assembly comprising:

a slip resistant mat having projections extending from the bottom face thereof;

means for framing the periphery of said slip resistant mat, said framing means receiving some of said mat periphery bottom projections extending completely through said framing means; and means for locking the free ends of said received projections together thereby locking said slip resistant mat to said framing means.

2. The assembly of claim 1 wherein said bottom projections comprise studs projecting outwardly from the bottom of said slip resistant mat.

3. The assembly of claim 2 wherein said framing means comprises a trim structure, said trim structure receiving some of said periphery studs.

4. The assembly of claim 3 wherein said received studs extend completely through said trim structure and wherein said locking means comprises means for joining together the ends of said studs extending through said trim structure.

5. The assembly of claim 4 wherein said trim structure includes a channel cut into the surface thereof, said received studs protruding through said trim structure into said channel.

6. The assembly of claim 5 wherein said joining means operates to join said stud ends together in said channel.

7. The assembly of claim 6 wherein said trim structure comprises a molding, said molding having said channel running lengthwise in the bottom surface of said molding, said ledge having a plurality of holes therein extending through said molding to said channel, said joined studs extending therein through with the bottom of said slip resistant mat resting on said ledge.

8. The assembly of claim 7 wherein said molding also includes a raised portion running lengthwise along the top of said molding, said raised portion forming a platform which borders said slip resistant mat top surface and abuts the edge thereof at the same elevation.

9. The assembly of claim 1 wherein said stud joining means includes an adhesive material which adheres to said stud ends joining said stud ends together.

10. The assembly of claim 9 wherein said adhesive material fills said molding channel about said stud ends.

11. The assembly of claim 10 wherein said adhesive material does not bond to said molding.

12. The assembly of claim 11 wherein said mat and said mat studs are of plastic material, said adhesive material is self-curing plastic adhesive and said molding is of wood material.

13. The assembly of claim 12 wherein said wood molding includes a beveled edge running lengthwise therealong on the other side of said raised platform from said mat joining ledge.

14. A method of assembling a slip resistant mat, having bottom projections, to a peripheral molding comprising the steps of:

inserting a portion of said bottom projections at the periphery of said mat through said molding; and joining the ends of said bottom projections together after same are passed through said molding.

15. The method of claim 14 also including before the step of inserting the step of providing a cavity projecting along said molding surface.

16. The method of claim 15 also including between the steps of providing and inserting the step of extending said peripheral molding completely about said mat.

17. The method of claim 16 wherein the step of joining said bottom projection ends includes the step of adhering together with an adhesive the ends of said bottom projections passed through said molding.

18. The method of claim 17 wherein the step of inserting includes inserting said inserted bottom projections through said molding to have the ends thereof extend into said provided molding surface cavity.

19. The method of claim 18 wherein said adhering step includes filling said molding surface cavity with said adhesive to bond said projecting ends extending thereinto together.

20. A slip resistant mat assembly comprising:

a slip resistant mat having projecting portions extending from the bottom face thereof;

a molding extending along the periphery of said mat said molding having a raised platform section extending lengthwise therealong, a beveled outer edge, and a lower ledge surface on the side of said molding opposite said beveled outer edge, said lower ledge providing a horizontal surface below the top of said bevel and said raised platform portion; and wherein the top face of said mat is at the same height as the top of said raised platform section, said platform section providing a border adjacent said mat and contiguous therewith, and a plurality of said projecting portions passing into said molding.

21. The slip resistant mat assembly of claim 20 wherein said molding includes a plurality of holes therethrough along said lower ledge surface into which said projecting portions pass and are secured.

22. The slip resistant mat assembly of claim 21 wherein said molding includes a channel extending lengthwise along the bottom face thereof, said plurality of holes opening thereinto; wherein some of said mat bottom face projections extend through said holes and into said channel; and also including means for joining together the free ends of said bottom face projections within said channel.

* * * * *

UNITED STATES PATENT AND TRADEMARK OFFICE

CERTIFICATE OF CORRECTION

PATENT NO. : 4,361,614

DATED : November 30, 1982

INVENTOR(S) : Merritt L. Moffitt, Jr.

It is certified that error appears in the above-identified patent and that said Letters Patent are hereby corrected as shown below:

Column 6 - Claim 9 - "The assembly of claim 1" should read "The assembly of claim 8".

Signed and Sealed this

First Day of March 1983

[SEAL]

*Attest:*

GERALD J. MOSSINGHOFF

*Attesting Officer*

*Commissioner of Patents and Trademarks*